US006820359B2

(12) United States Patent
Muljadi

(10) Patent No.: US 6,820,359 B2
(45) Date of Patent: Nov. 23, 2004

(54) IRON WITH CURVED BASE SURFACE

(75) Inventor: Basuki Muljadi, Kensington (AU)

(73) Assignee: Basuki Maljadi, Kensington ( * ) Notice: Subject to any disclaimer, the term of this patent is extended or adjusted under 35 U.S.C. 154(b) by 0 days.

(21) Appl. No.: 10/275,464

(22) PCT Filed: Mar. 22, 2001

(86) PCT No.: PCT/AU01/00318

§ 371 (c)(1),
(2), (4) Date: Mar. 27, 2003

(87) PCT Pub. No.: WO01/92631

PCT Pub. Date: Dec. 6, 2001

(65) Prior Publication Data

US 2003/0163935 A1 Sep. 4, 2003

(30) Foreign Application Priority Data

May 31, 2000 (AU) ..... PQ7877

(51) Int. Cl.[7] ..... D06F 75/38
(52) U.S. Cl. ..... 38/93
(58) Field of Search ..... 219/200, 211, 219/221, 222, 225, 227, 245; 38/93, 77.87, 89, 88, 95, 74, 729, 82, 97

(56) References Cited

U.S. PATENT DOCUMENTS

| | | | | | |
|---|---|---|---|---|---|
| 5,950 | A | * | 12/1848 | Cook | 38/93 |
| 145,676 | A | | 12/1873 | Mooney | |
| 185,786 | A | * | 12/1876 | Savery | 38/93 |
| 520,583 | A | * | 5/1894 | Trube | 38/92 |
| 620,305 | A | | 2/1899 | Hadaway, Jr. | |
| 864,735 | A | * | 8/1907 | Harper | 38/89 |
| 887,871 | A | * | 5/1908 | Taylor | 219/227 |
| D157,605 | S | * | 3/1950 | Krause | D24/214 |
| 6,513,269 | B2 | * | 2/2003 | Kobayashi et al. | 38/93 |

FOREIGN PATENT DOCUMENTS

| | | |
|---|---|---|
| DE | 2.712.805 | 9/1978 |
| DE | 29.611.410 | 12/1996 |
| EP | 409.470 | 1/1991 |
| FR | 2.680.183 | 2/1992 |

OTHER PUBLICATIONS

Hong Kong Household, vol. 2, 1999 issued Apr. 1999 (Hong Kong Trade Development Council), "A Clean Press" p. 22, lines 14–16.

* cited by examiner

*Primary Examiner*—Ismael Izaguirre
(74) *Attorney, Agent, or Firm*—Tucker Ellis & West LLP

(57) ABSTRACT

Iron (1) for garments includes curved base surface (2) wherein cross-section of curved base surface (2) in longitudinal direction and/or transverse direction is substantially semi-elliptical shape. Iron (1) includes handle (5) which allows movement of iron (1) in all directions across a surface.

19 Claims, 12 Drawing Sheets

IRON WITH CURVED BASE SURFACE

TECHNICAL FIELD

This invention relates to an iron and more particularly to an iron with a curved base surface for contacting garments to be ironed.

BACKGROUND ART

Typically ironing devices are constructed to have a flat base plate for contacting the garments to be pressed or ironed. They generally function by heating the base plate to a elevated temperature which facilitates the removal of undesirable wrinkles and creases in the garment. Additionally, irons are typically constructed such that steam issues from the underside of the base plate onto the garments during the ironing process. The steam aids removal of creases and wrinkles in the garment by providing a moist and humid environment during the ironing process.

The disadvantage of conventional irons constructed with flat base plates is that the entire surface of the base plate is always in contact with the fabric once the iron is pressed to the garment to be ironed. This is particularly disadvantageous when delicate material is being ironed, as the material may be subject to excessive contact with the base plate resulting in burn marks or destruction of the material.

The flat base plate also provides that a degree of downward force be applied to the iron as this force is distributed evenly across the surface of the entire base plate and then transferred onto the garment being ironed, thus the resulting pressure applied to the garment for a given downward force is proportional to the entire surface area of the flat base plate.

Conventional irons are usually constructed with a handle that is horizontally disposed to the ironing surface and which is elongated in the direction of the contacting base plate. An operator of an ironing device of this nature would typically grip the handle in a closed grip whereby the operator's fingers are positioned underneath one side of the handle and the thumb loops around the other the other side as if gripping handlebars or the like. This has the disadvantage whereby a person operating the iron is substantially restricted to ironing in the direction in which the handle is orientated.

DISCLOSURE OF INVENTION

The present invention seeks to provide an iron which overcomes the above disadvantages. The present invention also seeks to provide an iron with a handle that allows free movement of the iron in any direction.

According to the present invention there is provided an iron including a curved base surface.

Preferably, the cross-section of the curved base surface in the longitudinal direction is a substantially semi-elliptical shape.

Preferably, the cross-section of the curved base surface in the transverse direction is a substantially semi-elliptical shape.

Preferably, the cross-sections of the curved base surface in the longitudinal and transverse directions are substantially semi-elliptical shapes.

Preferably, the curved base surface is in a substantially semi-ellipsoid shape.

Preferably, the curved base surface is elongated in the longitudinal direction.

Preferably, the curved base surface consists of a front portion and a back portion wherein the back portion has a greater width in the transverse direction than the front portion.

Preferably the front portion consists of a point which substantially defines the centre axis of the curved base surface.

Preferably, the curved base surface consists of openings through which steam may be emitted.

Preferably, the openings are aligned along the central axis of the curved base surface.

Preferably, the curved base surface includes a steam chamber in connection with said openings.

The base surface can be formed from any suitable materials such as for example metals and alloys such as aluminium, steel or brass.

Preferably, the iron includes a handle for operating said iron which when operated allows movement of said iron in all directions across a surface.

Preferably, said handle is in a substantially spherical shape and can be formed from any suitable materials such as for example wood or plastic or metals and alloys.

Preferably, said handle is made from wood.

Preferably, the iron includes a heat resistant layer positioned between the base surface and a main body portion of the iron.

Preferably, the heat resistant layer is made of a heat resistant plastic.

Preferably, the main body portion includes a steam shield portion situated on the periphery of said main body portion.

Preferably, the main body portion includes a handle running in a longitudinal direction of the iron wherein the handle allows free movement of the iron in any direction during use.

Preferably, the handle includes a pressure sensitive steam operation means.

BRIEF DESCRIPTION OF THE DRAWINGS

The present invention will become better understood from the following detailed description of preferred but non-limiting embodiments thereof, described in connection with the accompanying drawings, where in.

DETAILED DESCRIPTION OF THE INVENTION

Figure 1:
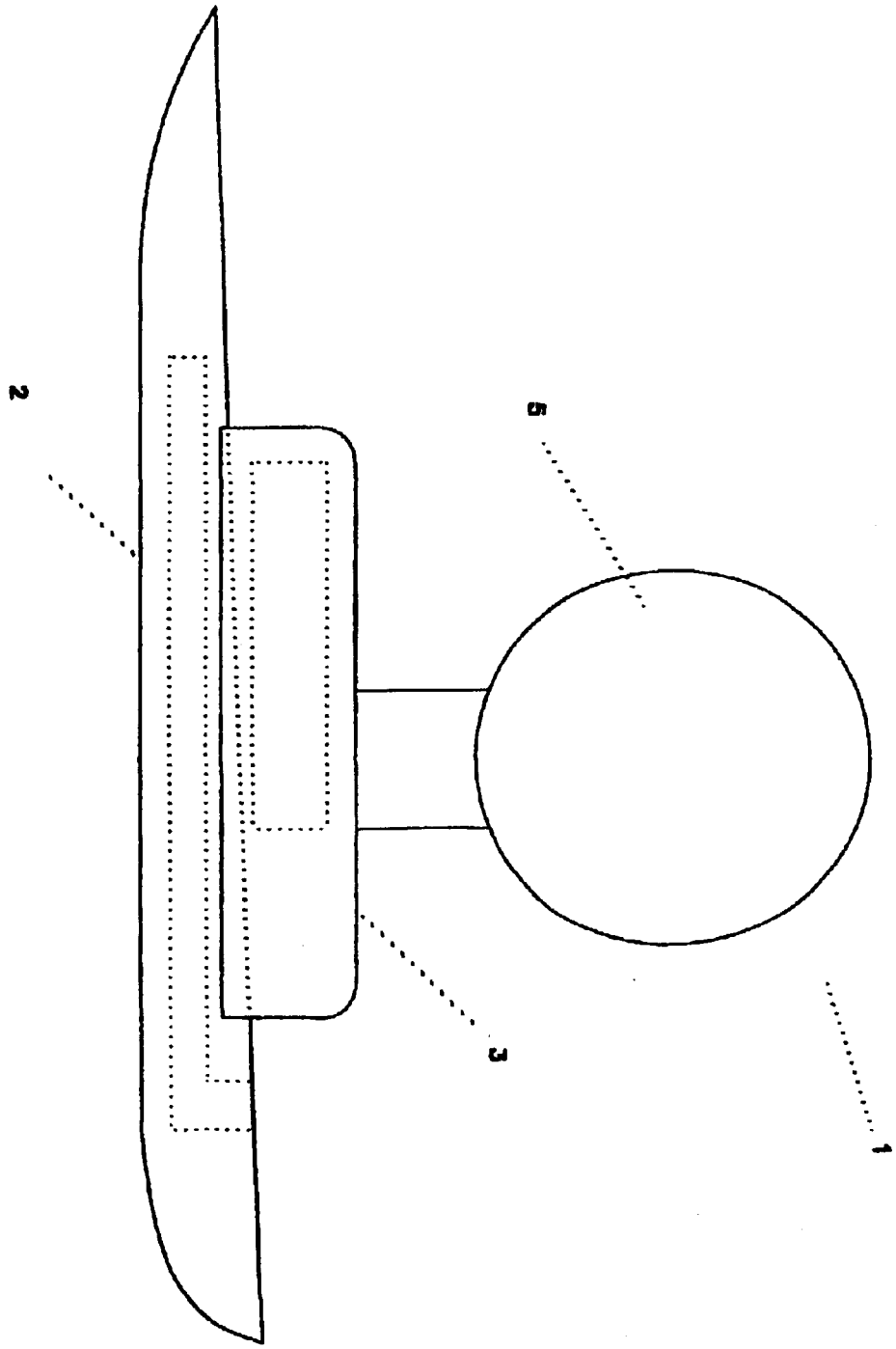
FIG. 1. illustrates a preferred embodiment of the present invention wherein the figure shows a cross-sectional view of an iron in the longitudinal direction.
Figure 2:
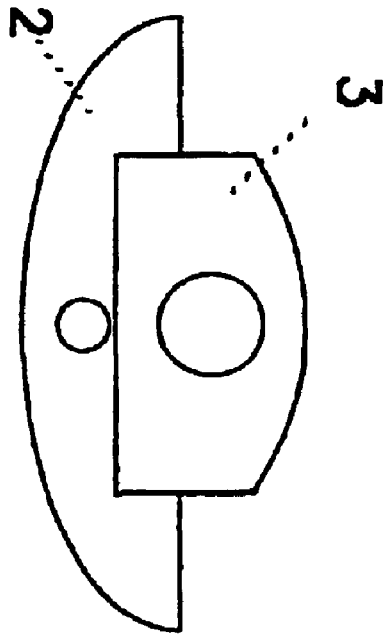
FIG. 2. illustrates a preferred embodiment of the present invention wherein the figure shows a cross-sectional view of an iron in the transverse direction.
Figure 3:
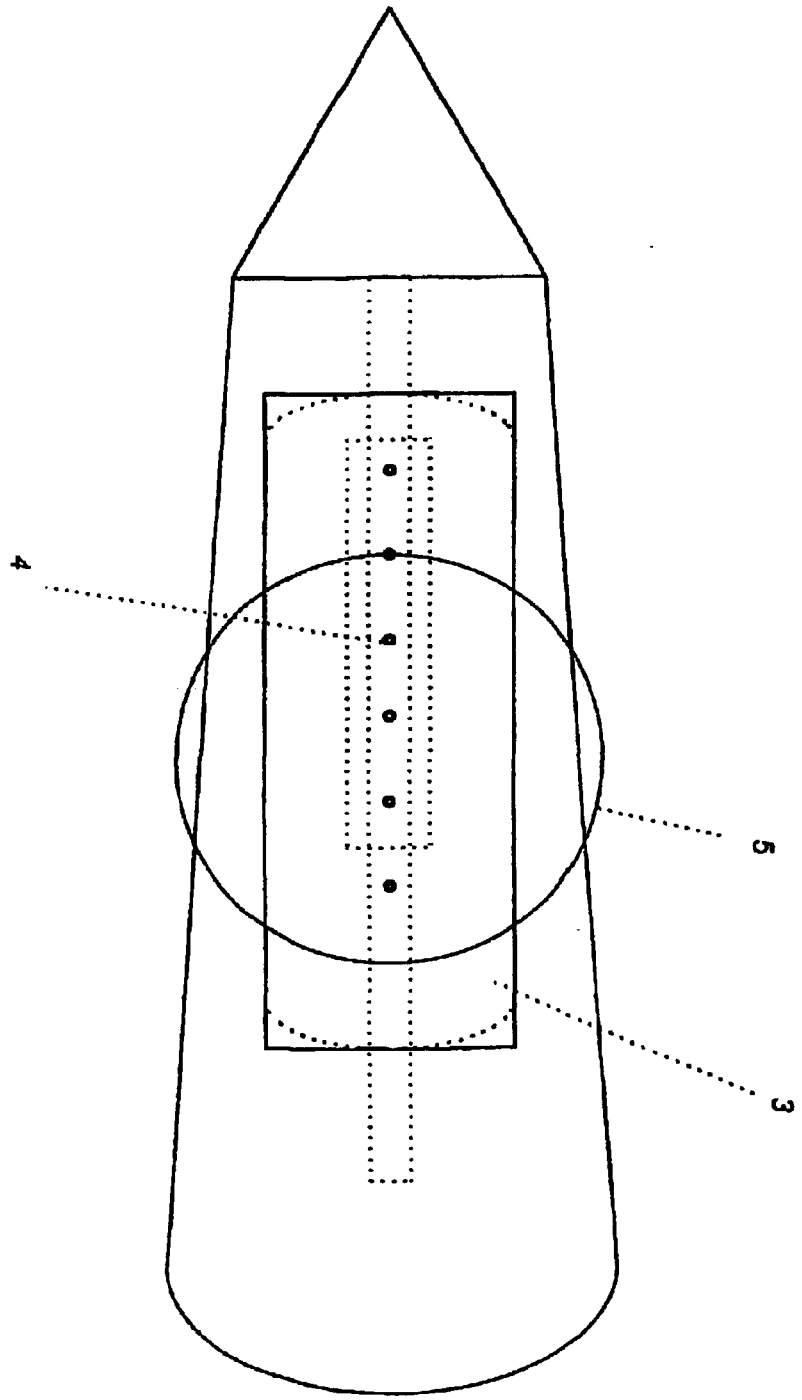
FIG. 3. illustrates a preferred embodiment of the present invention wherein the figure shows an above view of an iron.

A preferred, but non-limiting embodiment of the present invention is shown in FIGS. 1,2 and 3. The iron 1 consists of a blase surface 2 which has a curved surface for contacting the garments or material to be ironed. The base surface 2 is connected to a main body portion 3 which houses a heating mechanism and/or steam generation mechanism. The heating mechanism transfers heat to the base surface 2 to facilitate in the ironing process and the steam generation mechanism generates steam which may be pushed out of orifices 4 located on the curved surface of the base surface 2. The main body portion 3 is coupled to a handle 5 which is in the form of a sphere such that the ironing device 1 may be held in a fashion that allows the iron 1 to be operated in any direction the operator so wishes.

As can be seen from FIG. 1, the cross-section of the base surface 2 in the longitudinal direction is a semi-elliptical shape, and, as can be seen from FIG. 2, the cross-section of the base surface 2 in the transverse direction is also a semi-elliptical shape.

Figure 4:
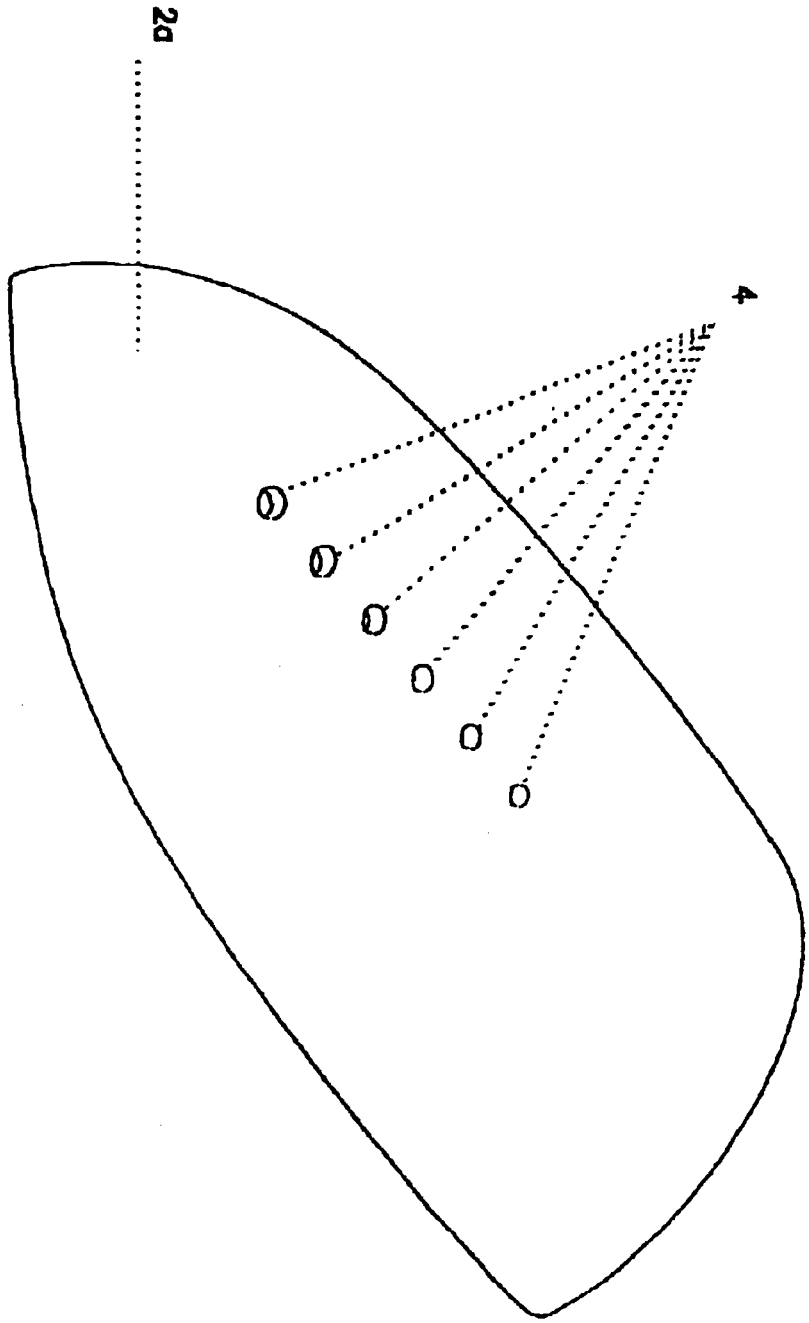
FIG. 4. illustrates another preferred embodiment of the present invention wherein the figure shows an above view of a base surface of an iron with the main body portion removed.
Figure 5:
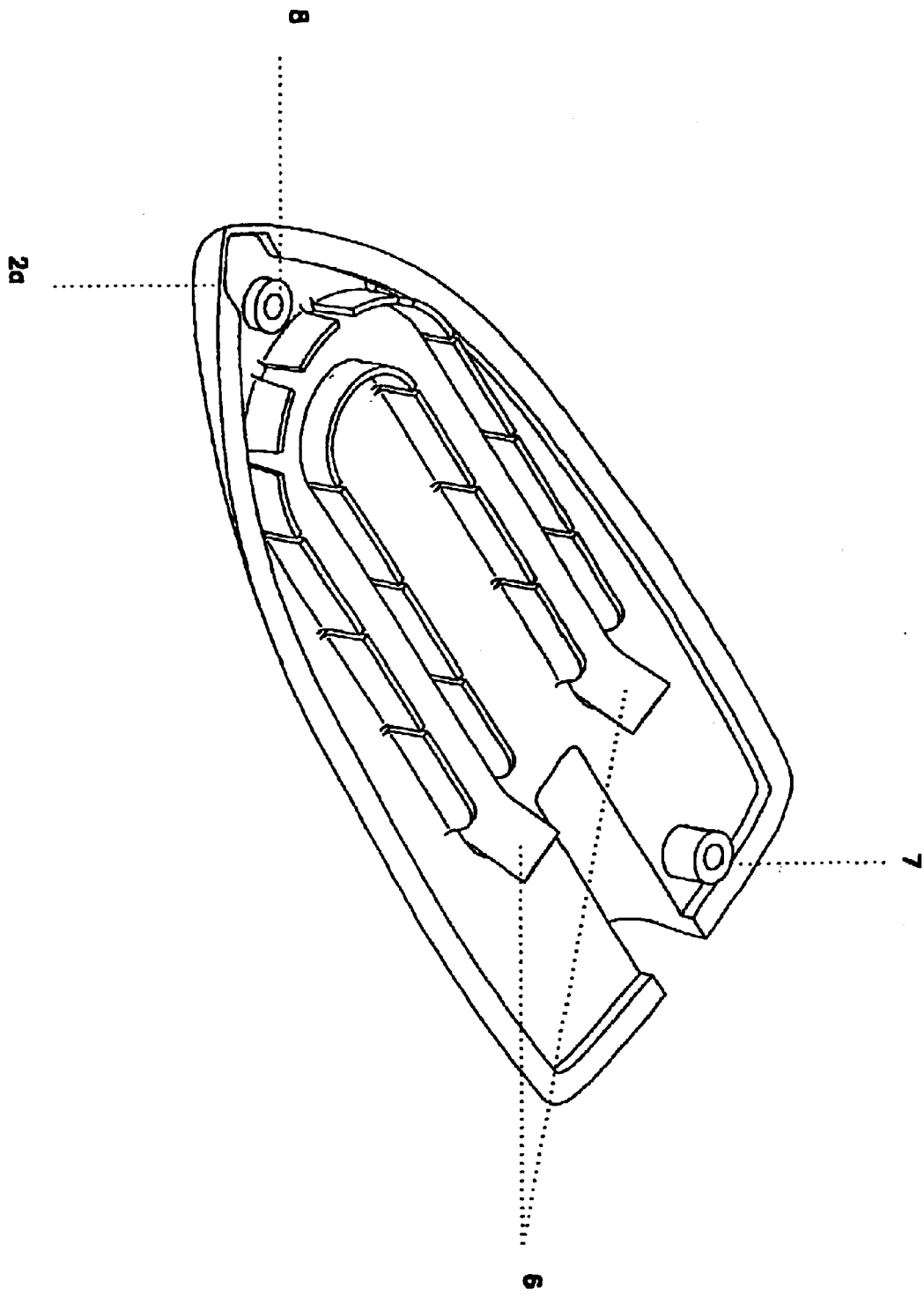
FIG. 5. illustrates another preferred embodiment of the present invention wherein the figure shows the underside of a base surface of an iron.

Referring to FIGS. 4 and 5, there is shown another preferred embodiment of the present invention, FIG. 5 shows an above view of a base surface 2*a* of an iron, including a curved surface for contacting clothes to be ironed, with the main body portion removed. The heating element 6 of the heating mechanism is in direct contact with a substantial part of the base surface 2 and transfers the heat generated by the heating mechanism to the base surface 2. Steam generated by the steam generation mechanism passes through steam ports 8,7 into a steam cavity drilled out of the base surface along a central axis of the iron. The steam may issue out of the base surface from the orifices 4 which are located on the curved surface of the base surface 2 along a central axis, and, which are in connection with the steam cavity. The position of the orifices 4 along a central axis is advantageous for the base surface 2 from a construction perspective as the steam cavity may be simply drilled out of a die cast base plate.

Figure 6:
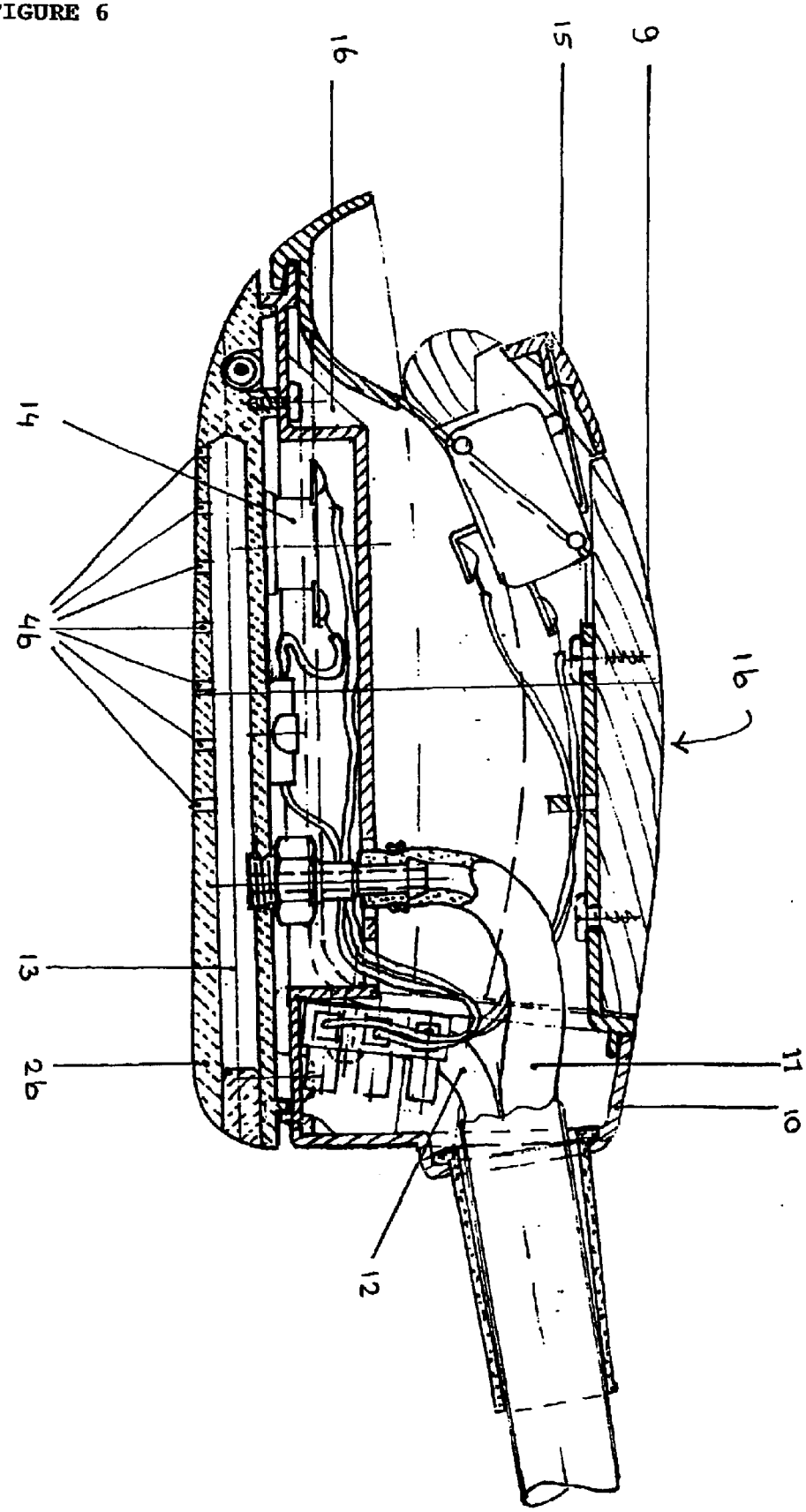
FIG. 6. illustrates another preferred embodiment of the present invention wherein the figure shows a cross-sectional view of an iron in the longitudinal direction.
Figure 7:
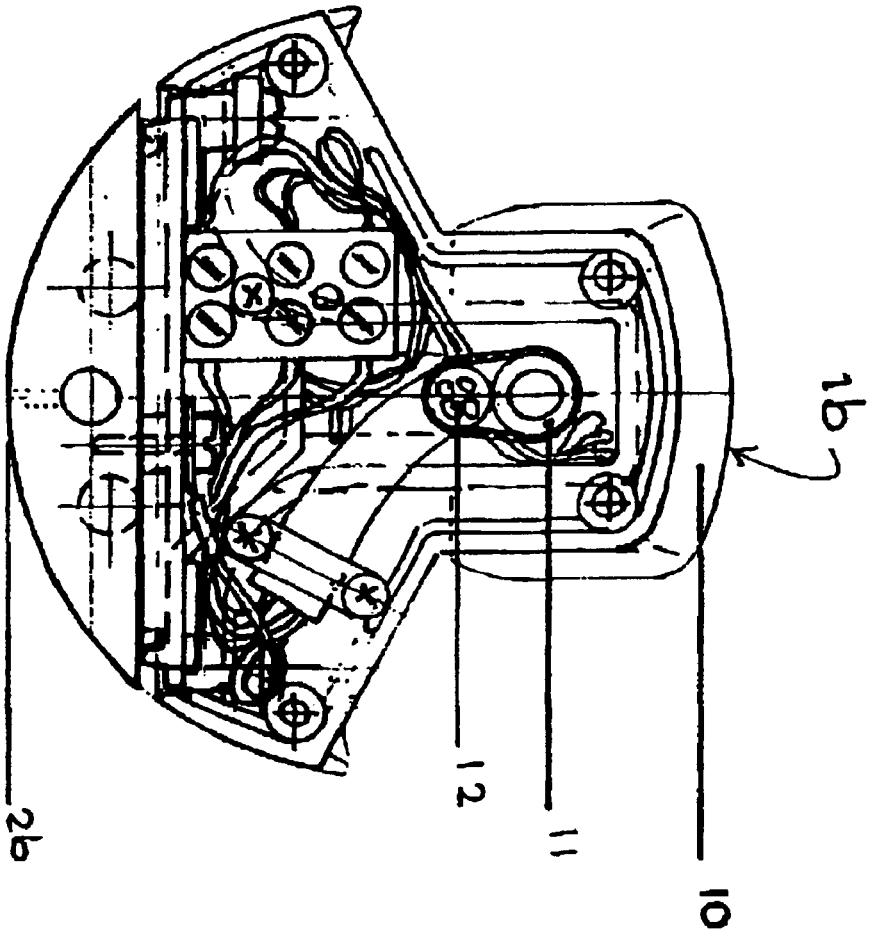
FIG. 7. illustrates another preferred embodiment of the present invention wherein the figure shows a cross-sectional view of an iron in the transverse direction.
Figure 8:
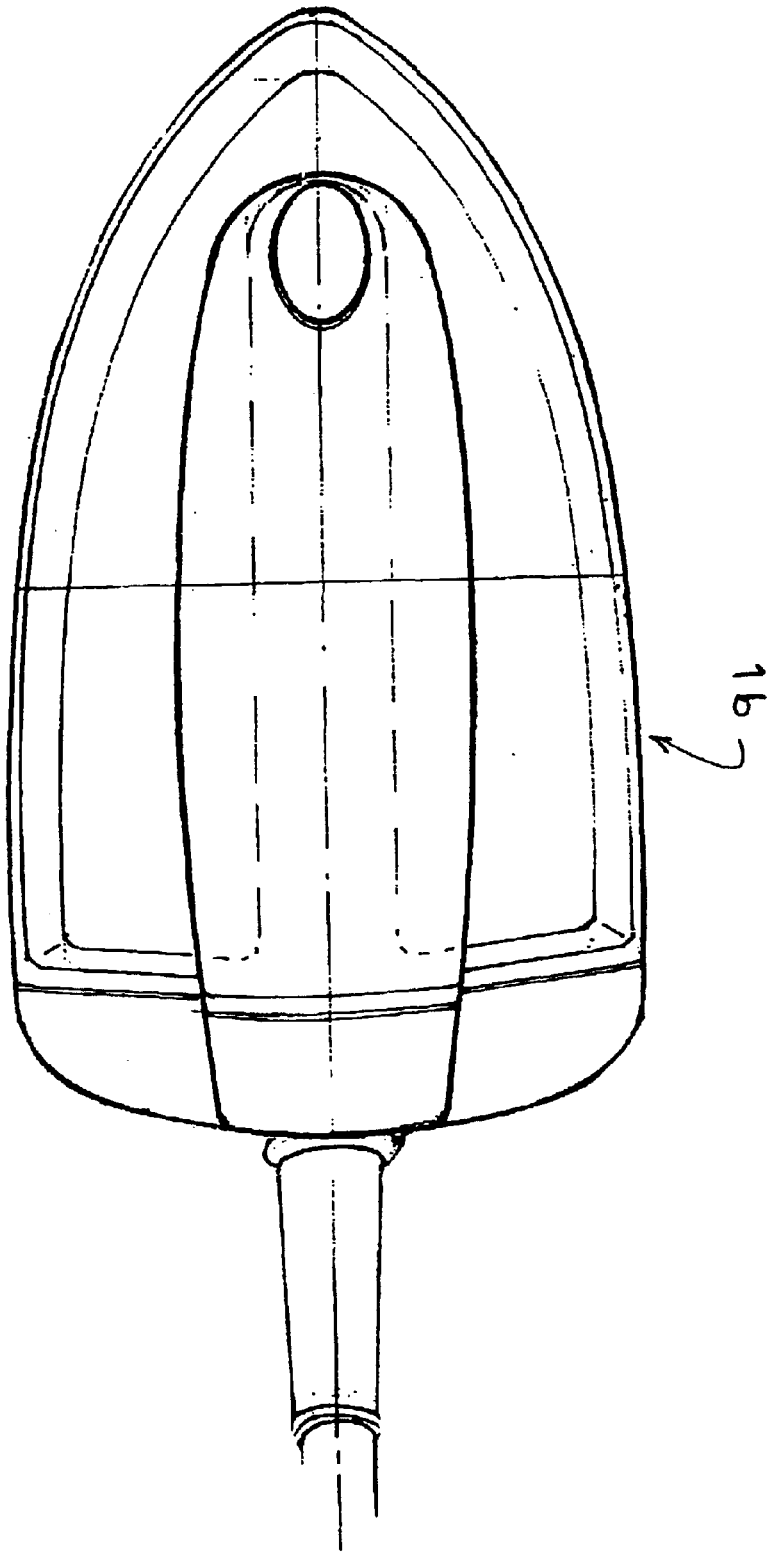
FIG. 8. illustrates another preferred embodiment of the present invention wherein the figure shows an above view of an iron.

Referring to FIGS. 6, 7 and 8 there is shown a farther preferred embodiment of the present invention. FIG. 6 shows a cross-sectional view of an iron 1*b* in the longitudinal direction with a handle 9 shaped to provide for a particular hand grip similar to that depicted in FIG. 9 and which allows free movement of the iron 1*b* in any direction. A Power cable 12 and a steam tube 11 enter the iron 1*b* from a rear sealing cap 10 which is composed of polypropylene moulding. In this embodiment the steam is generated externally from the iron 1*b* and travels to the iron 1*b* via the steam tube 11 where it is pushed into a steam cavity 13 and expelled via orifices 4*b*. A steam control button 15 can be operated to control the expulsion of the steam as desired. The curved base surface 2*b* in this embodiment could be composed of any suitable material such as for example die cast aluminium.

A thermostat 14 is used to control how much heat is transferred onto the base surface 2*b*. The body of the iron 1*b* directly supporting the base surface and steam chamber is composed of suitable material which can withstand high temperatures and which has insulating properties.

Figure 9:
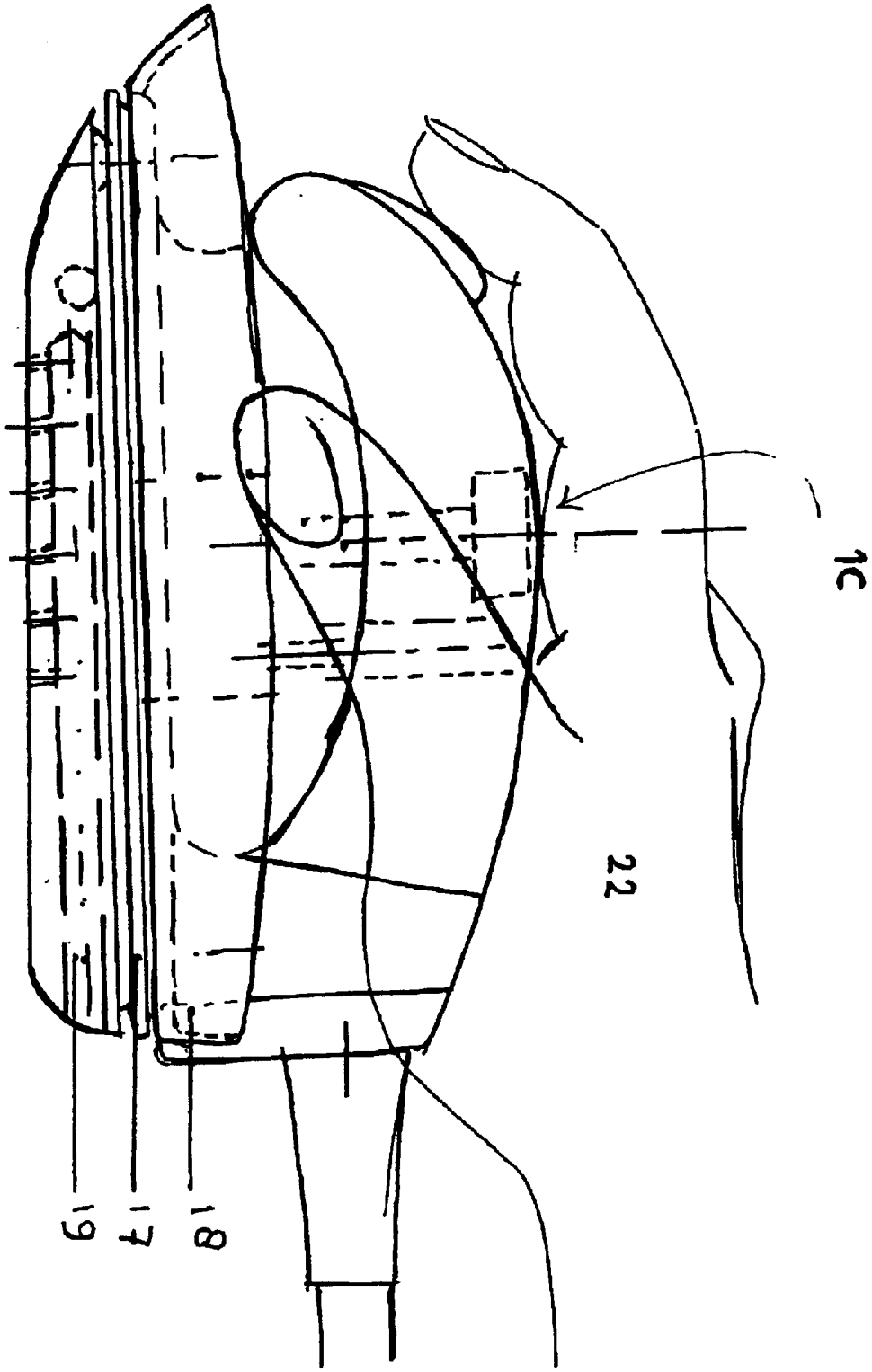
FIG. 9. illustrates another preferred embodiment of the present invention wherein the figure shows an iron in the longitudinal direction in connection with a hand positioned for operation of the iron.
Figure 10:
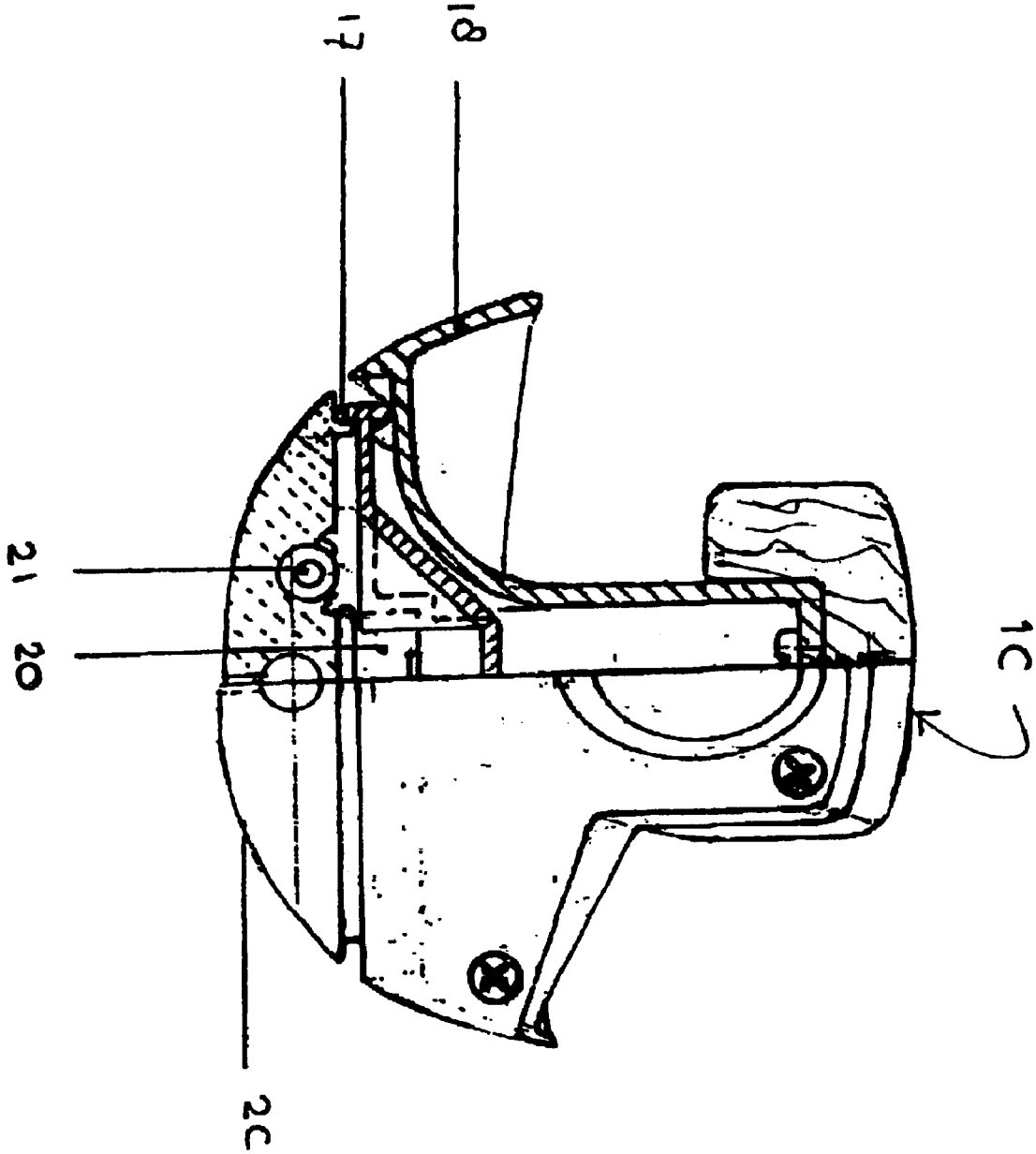
FIG. 10. illustrates another preferred embodiment of the present invention wherein the figure shows a cross-sectional view of an iron in the transverse direction.
Figure 11:
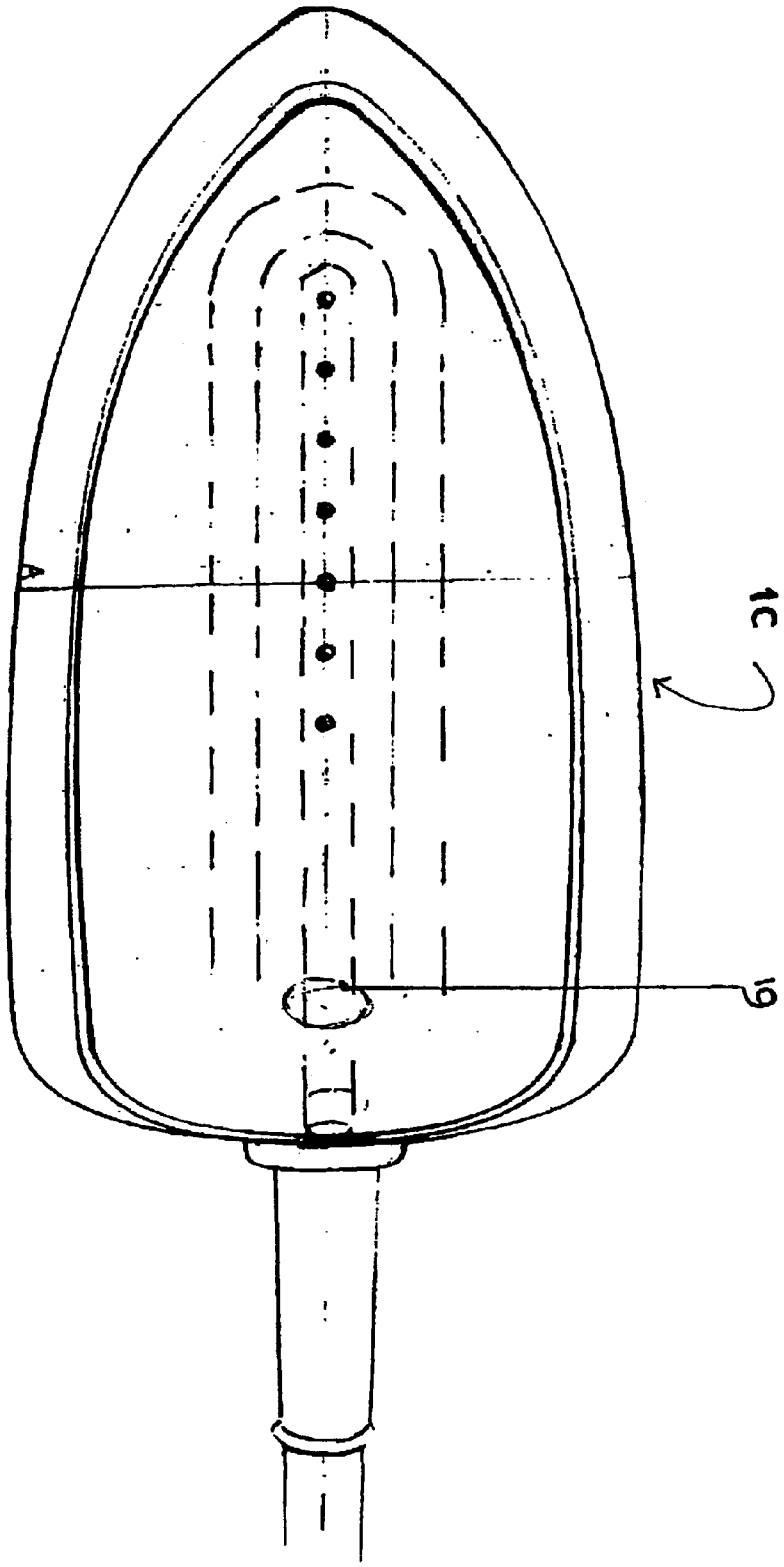
FIG. 11. illustrates another preferred embodiment of the present invention wherein the figure shows an underside view of an iron.

Referring to FIGS. 9, 10 and 11, there is shown yet another preferred embodiment of the present invention. FIG. 9 shows a cross-sectional view of an iron 1*c* where an image of a hand 22 has been superimposed to show how the iron may be held to allow free movement in any direction during use. This iron 1*c* also includes a steam shield 18 which can be made out of any suitable material such as for example polypropylene. The shield 18 prevents the fingers from being heated beyond a comfortable level by the steam which may issue from the bottom of the iron 1*c*. A heat shield 17 between the curved base surface 2*c* and the steam shield 18 is provided to protect the steam shield from direct contact with the curved base surface and to prevent the shield from reaching a temperature that would be uncomfortable to the touch. The heat shield 17 can be composed of any suitable heat resistant material.

Figure 12:
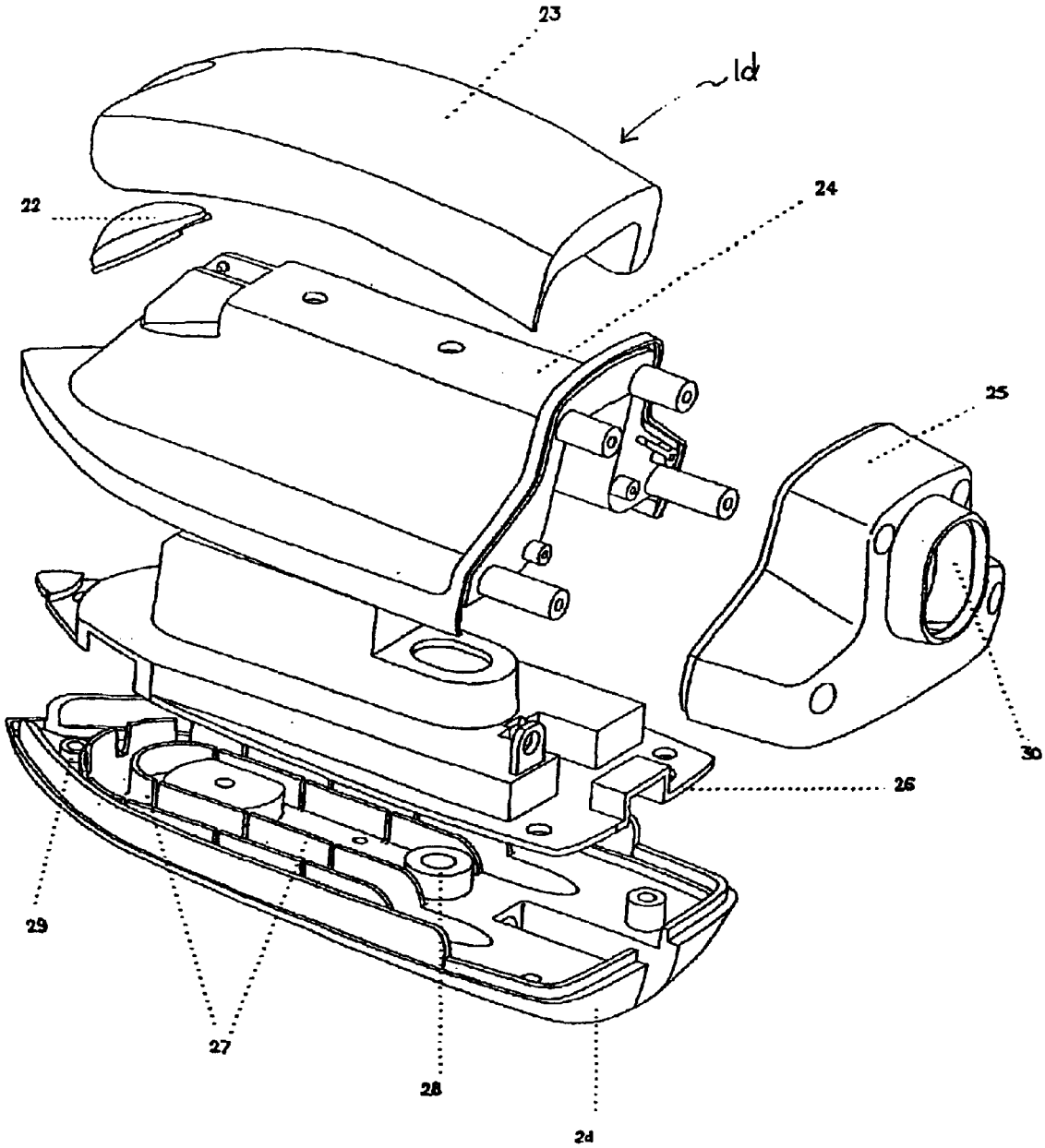
FIG. 12. illustrates an exploded view of a preferred embodiment of the present invention.

Referring to FIG. 12, there is shown an exploded view of an iron 1*d* in accordance with another aspect of the present invention. A base surface 2*d*, which includes a curved surface for contacting material to be ironed, is shown to include contact points for the heating mechanism 27 and steam entry points 28, 29 to a steam cavity located on a central axis within the base surface 2*d*. The base surface 2*d* would normally be attached to a heat shield layer 26 which in turn would normally be attached to the main body portion 24 of the iron and a rear sealing cap 25 which includes an entry point 30 for steam and/or power supply. The heat shield layer can be composed of any suitable material that is suitably heat resistant and has suitable insulating properties.

A handle 23 is shown which provides that the iron may be held to allow free movement in any direction during use. The handle 23 may be composed of any suitable material such as for example wood. The handle 23 is normally attached to the main body portion 24 of the iron and includes a steam control button 22 which may control the steam expulsion from the base surface 2*d*.

Throughout this specification the word "iron", will be understood to imply a device or iron which is used to contact garments or materials for the purposes of removing creases or wrinkles in either a domestic or commercial environment The reference to any prior art in this specification is not, and should not be taken as, an acknowledgment or any form of suggestion that that prior art forms part of the common general knowledge in Australia.

Although several preferred embodiments have been described in detail, it should be understood that various changes, substitutions, and alterations can be made herein by one ordinarily skilled in the art without departing from the spirit or scope of the present invention.

What is claimed is:

1. An ironing device for ironing garments comprising:

a body portion having a top and a bottom;

a handle extending from the top of the body portion, wherein the handle allows movement of the ironing device in all directions across a surface;

a base surface for contacting the garment to be ironed located on the bottom of the body portion, wherein at least a portion of the base surface is curved in shape, wherein the cross section of the curved portion of the base surface in the transverse direction is substantially semi-elliptical in shape; and heating means adapted to transfer heat to the base surface to facilitate ironing.

2. The ironing device according to claim 1 wherein the cross section of the curved portion of the base surface in the longitudinal section is substantially semi-elliptical in shape.

3. The ironing device according to claim 1 wherein the curved portion of the base surface is substantially semi-ellipsoid in shape.

4. The ironing device according to claim 1 wherein the base surface is elongated in the longitudinal direction.

5. The ironing device according to claim 1 wherein the base surface has a front portion and a back portion, wherein the back portion has a greater width in the transverse direction than the front portion.

6. The ironing device according to claim 5 wherein the front portion tapers in width to a point, wherein such point substantially defines the central axis of the base surface.

7. The iron device according to claim 1 further comprising:

steam generating means adapted to generate steam; and at least one opening in the base surface in communication with the steam generating means and through which steam generated by the steam generating means is emitted.

8. The ironing device according to claim 7 wherein the steam generating means are located within the body portion.

9. The ironing device according to claim 7 wherein the at least one opening is aligned along the central axis of the base surface.

10. The ironing device according to claim 7 further comprising a steam chamber located in the base surface for storing steam generated by the steam generating means and in communication with the at least one opening.

11. The ironing device according to claim 1 wherein the base surface is comprised of metals and alloys selected from the group consisting of aluminum, steel, and brass.

12. The ironing device according to claim 1 wherein the handle extends from the top of the body portion in a longitudinal direction.

13. The ironing device according to claim 12 wherein the handle has a pressure sensitive control means adapted to control steam emitted from at least one opening.

14. The ironing device according to claim 12 wherein the handle is substantially spherical in shape.

15. The ironing device according to claim 12 wherein the handle is comprised of wood.

16. The ironing device according to claim 1 further comprising a heat resistant layer positioned between the base surface and the body portion.

17. The ironing device according to claim 16 wherein the heat resistant layer is comprised of a heat resistant plastic.

18. The ironing device according to claim 1 further comprising a steam shield located on the periphery of the body portion.

19. The ironing device according to claim 1 wherein the heating means are in contact with at least a portion of the base surface and transfers heat to the base surface.

* * * * *